US009764222B2

(12) United States Patent
Horovitz

(10) Patent No.: US 9,764,222 B2
(45) Date of Patent: Sep. 19, 2017

(54) SYSTEM AND METHOD FOR CALCULATING VALUES IN TILE GAMES

(71) Applicant: EYECUE VISION TECHNOLOGIES LTD., Yokneam Ilite (IL)

(72) Inventor: Ronen Horovitz, Haifa (IL)

(73) Assignee: EyeCue Vision Technologies Ltd., Yokneam Illit (IL)

( * ) Notice: Subject to any disclaimer, the term of this patent is extended or adjusted under 35 U.S.C. 154(b) by 0 days.

(21) Appl. No.: 14/847,029

(22) Filed: Sep. 8, 2015

(65) Prior Publication Data

US 2015/0375098 A1 Dec. 31, 2015

Related U.S. Application Data

(63) Continuation of application No. 13/490,467, filed on Jun. 7, 2012, now Pat. No. 9,138,636, which is a continuation-in-part of application No. 12/600,293, filed as application No. PCT/IL2008/000675 on May 18, 2008, now Pat. No. 8,210,945, said application No. 13/490,467 is a continuation-in-part of application No. 13/201,512, filed as application No.

(Continued)

(51) Int. Cl.

| | |
|---|---|
| ***H04N 7/18*** | (2006.01) |
| ***G06F 17/00*** | (2006.01) |
| ***A63F 3/04*** | (2006.01) |
| ***A63F 11/00*** | (2006.01) |
| ***A63F 3/00*** | (2006.01) |
| *A63F 9/24* | (2006.01) |

(52) U.S. Cl.

CPC ..... *A63F 3/0423* (2013.01); *A63F 3/00643* (2013.01); *A63F 11/0051* (2013.01); *A63F 2003/0428* (2013.01); *A63F 2009/2435* (2013.01); *A63F 2011/0058* (2013.01)

(58) Field of Classification Search

USPC ..... 463/2–6, 30–36, 11; 348/143

See application file for complete search history.

(56) References Cited

U.S. PATENT DOCUMENTS

| | | | |
|---|---|---|---|
| 3,904,207 | A | 9/1975 | Gold |
| 5,168,531 | A | 12/1992 | Sigel |
| 5,687,333 | A | 11/1997 | Dobashi |

(Continued)

FOREIGN PATENT DOCUMENTS

| | | |
|---|---|---|
| WO | WO2008152644 A3 | 12/2008 |
| WO | WO/2009/007978 | 1/2009 |

OTHER PUBLICATIONS

WIPO, International Preliminary Report on Patentability Chapter I for PCT/IL2012/00023, Jul. 16, 2013.

(Continued)

*Primary Examiner* — Ronald Laneau

(74) *Attorney, Agent, or Firm* — Siritzky Law, PLLC

(57) ABSTRACT

A system and method for capturing an image of letter tiles such as letter tiles used in a game play, and comparing one or more configurations of the letter tiles in the captured image to one or more words that are stored in a memory associated with the imager that captured the image. A signal may be issued to upon a match or mismatch of one or more of the words configured by letter tiles in the captured image to one or more of the words stored in the memory.

18 Claims, 2 Drawing Sheets

Related U.S. Application Data

PCT/US2010/044343 on Aug. 4, 2010, now Pat. No. 9,498,721.

(60) Provisional application No. 60/924,463, filed on May 16, 2007, provisional application No. 61/231,216, filed on Aug. 4, 2009.

(56) References Cited

U.S. PATENT DOCUMENTS 5,855,483 A 1/1999 Collins et al.
5,900,863 A 5/1999 Numazaki
6,049,281 A 4/2000 Osterweil
6,115,482 A 9/2000 Sears
6,378,867 B1 4/2002 Shalless
6,422,561 B1 7/2002 Schroeder
6,466,205 B2 10/2002 Simpson
6,690,156 B1 2/2004 Weiner et al.
6,745,236 B1 6/2004 Hawkins et al.
6,967,566 B2 11/2005 Weston et al.
7,051,935 B2 5/2006 Sali et al.
7,389,002 B1 6/2008 Knight
7,515,734 B2 4/2009 Horovitz et al.
7,644,926 B2 1/2010 Teeple
7,720,257 B2 5/2010 Morellas et al.
7,855,811 B2 * 12/2010 Silverbrook ..... G06F 3/0317 358/403
8,070,163 B2 12/2011 Ogilvie
8,126,264 B2 2/2012 Kaftory et al.
8,144,121 B2 3/2012 Kitaura
8,167,721 B2 5/2012 Fujisawa
8,482,534 B2 7/2013 Pryor
8,576,199 B1 11/2013 Pryor
9,061,196 B2 6/2015 Kingsley
9,095,768 B1 8/2015 Bohadi
2002/0114491 A1 8/2002 Sharma
2005/0244072 A1 11/2005 Imai
2006/0056732 A1 3/2006 Holmes
2006/0083423 A1 4/2006 Brown et al.
2006/0125691 A1 * 6/2006 Menache ..... A63F 13/06 342/450
2006/0136180 A1 6/2006 Hansen et al.
2006/0258446 A1 11/2006 Nguyen et al.
2007/0016790 A1 1/2007 Brundage et al.
2007/0019808 A1 1/2007 Gonzalez
2007/0158434 A1 7/2007 Fan
2007/0262984 A1 11/2007 Pruss
2008/0004093 A1 1/2008 Van Luchene et al.
2008/0167102 A1 * 7/2008 Diakopoulos et al. . A63F 13/10 463/11
2008/0192129 A1 8/2008 Walker
2008/0260244 A1 10/2008 Kaftory et al.
2008/0284864 A1 11/2008 Kotake
2009/0057400 A1 3/2009 Silverbrook et al.
2009/0110239 A1 4/2009 Chen
2009/0152357 A1 6/2009 Lei
2009/0154778 A1 6/2009 Lei
2009/0180669 A1 7/2009 Horovitz et al.
2010/0103132 A1 4/2010 Ikeda
2011/0193990 A1 8/2011 Pillman et al.
2011/0298922 A1 12/2011 Horovitz
2011/0300516 A1 12/2011 Wigdor et al.
2012/0056992 A1 3/2012 Kuroda
2012/0199066 A1 8/2012 Hoshino
2012/0249741 A1 10/2012 Maciocci
2012/0299876 A1 11/2012 De Leon
2013/0110804 A1 5/2013 Davis
2013/0113888 A1 5/2013 Koguchi
2013/0190087 A1 7/2013 Somarajapuram
2013/0217491 A1 * 8/2013 Hilbert ..... A63F 13/00 463/31
2013/0294700 A1 11/2013 Kaftory
2014/0320668 A1 10/2014 Kalevo
2015/0117789 A1 4/2015 Miyashita
2015/0371103 A1 12/2015 Kaftory
2016/0228773 A1 * 8/2016 Fatulescu et al. .... A63F 13/537

OTHER PUBLICATIONS

WIPO, Written Opinion of the International Search Authority for PCT/IL2012/00023, Jul. 16, 2013.
WIPO, International Search Report for PCT/IL2012/00023, Jul. 19, 2012.
WIPO, International search report for PCT/IL2008/000675, Feb. 25, 2010.
WIPO, International Preliminary Report on Patentability Chapter I for PCT/IL2008/000675, Jan. 19, 2010.
WIPO, Written Opinion of the International Search Authority for PCT/IL2008/000675, Nov. 16, 2009.
WIPO, International Preliminary Report on Patentability Chapter I for PCT/US2010/044343, Feb. 7, 2012.
WIPO, Written Opinion of the International Search Authority for PCT/US2010/044343, Feb. 4, 2012.
WIPO, International Search Report for PCT/US2010/044343, Feb. 10, 2011.
USPTO, Non-Final Office Action dated Oct. 2, 2015 in U.S. Appl. No. 14/726,689.

* cited by examiner

SYSTEM AND METHOD FOR CALCULATING VALUES IN TILE GAMES

CROSS REFERENCE TO RELATED APPLICATION

This application is a continuation of U.S. patent application Ser. No. 13/490,467, filed on Jun. 12, 2012, entitled "SYSTEM AND METHOD FOR CALCULATING VALUES IN TILE GAMES," now U.S. Pat. No. 9,138,636, issued Sep. 22, 2015, which was: (A) a continuation-in-part of U.S. patent application Ser. No. 12/600,293, filed on Nov. 16, 2009, now U.S. Pat. No. 8,210,945, entitled "SYSTEM AND METHOD FOR PHYSICALLY INTERACTIVE BOARD GAMES," which is a U.S. National Phase Application of PCT International Application PCT/IL2008/000675, International Filing Date May 18, 2008, which claimed priority from U.S. Provisional Patent Application No. 60/924,463, filed on May 16, 2007, and (B) a continuation-in-part of U.S. patent application Ser. No. 13/201,512, filed Aug. 15, 2011, entitled "SYSTEM AND METHOD FOR OBJECT EXTRACTION," issued as U.S. Pat. No. 9,498,721, which is a National Phase Application of PCT International Application No. PCT/US2010/044343, International Filing Date Aug. 4, 2010, which claimed priority from U.S. Provisional Patent Application No. 61/231,216, filed on Aug. 4, 2009; all of which are incorporated herein by reference in their entirety.

FIELD OF THE INVENTION

The invention pertains generally to image recognition and interactive entertainment. More specifically, this application relates to using an imaging device to calculate a score in a word tile or letter tile game.

BACKGROUND OF THE INVENTION

Letter and word tile games are popular entertainment pastimes. Typically, players calculate and keep scores in such games with pegs or markers that may be provided with a game set or with pen and paper or in other simple ways. Determining a suitability of a word or sentence with the rules of the game may be done with a dictionary or other reference book.

SUMMARY OF THE INVENTION

Embodiments of the invention may include a system for interactive gaming, where such a system has an imager to capture a series of images of game tiles in a game space, a memory to store a value that is associated with one or more of the game tiles, and a processor to detect a first configuration of game tiles, such configuration including for example words, equations or other grouping of game tiles in a first of the images, and to detect a second configuration of game tiles in a second image. The processor may identify a difference between the configuration of words or tiles in the first image and a configuration of words or tiles in the second image. The processor may calculate a value of the difference of the configurations of words between the two images in accordance with the pre-defined values of the game tiles, and issue a signal indicating the value of the difference between the configurations of words in the first image and the configuration of words or tiles in the second image.

In some embodiments, the imager may capture the series of images of tiles that rest on a game board, and the processor may identify a position of such tiles relative to positions on the game board.

In some embodiments, the memory may store an indication of words such as a dictionary, and the processor may compare the words or configurations of tiles that are included in the difference between the configuration in the first image and the configuration in the second image with the stored words. The processor may issue a signal if one or more of the words does not match the words stored in the memory.

In some embodiments, a processor may add a value of the difference between the configurations in the two images to a value stored in the memory, and may associate a result of such adding with a user.

In some embodiments, the imager may capture an image of an item, such as a ring, bracelet, sleeve, skin color or other item, appearing in an image, and the processor may associate the item with a user. The processor may associate the value of the difference in configurations between the two images with the user and with a score of such user stored in a memory associated with such user.

In some embodiments, an imager may capture an image of other game tiles, such as those in reserve or in a hand of a player, and may compare a combination of (i) one or more of the other games tiles with (ii) a configuration of tiles on the game board to a list of words or configurations of tiles in a dictionary or compendium stored in a memory. The processor may issue a signal of a match of the comparison.

Some embodiments may include a method of automated scoring of a tile game, where the method includes capturing an image of a scene of a tile game; detecting from the image a tile that was added to the scene of the game during a turn of play; and calculating a value of the detected tile that was added to the scene, in accordance with rules of the game.

In some embodiments, detecting includes detecting a tile added to the scene during a particular turn of play; and calculating includes calculating a value of the tiles added to such scene. Such embodiment may also include comparing the tiles added to the scene during a turn of play to a stored compilation of combinations of tiles, and adding the value to a stored score of the player executing the turn of play.

In some embodiments, detecting may include capturing a first image of the tile game before a turn is taken by a player, and capturing a second image of the game after the turn is taken, and comparing a configuration of tiles in the first image with a configuration of tiles in the second image. Such image may include an image of the board of the game In some embodiments, calculating a value may include calculating the value as a function of the detected location of the tile on the board, so that if a tile is on a particular location of the board, the value of the tile may be multiplied by two or three, or may assume another value.

Some embodiments may include an imager to capture an image of a playing board on which are placed tiles, a memory to store a rule of play and an association of a tile with values; and a processor to identify a playing tile on the board in the image; associate the identified playing tile with a value; and calculate a value of the tile in accordance with a rule of play.

BRIEF DESCRIPTION OF THE DRAWINGS

Embodiments of the invention are illustrated by way of example and not limitation in the figures of the accompanying drawings, in which like reference numerals indicate corresponding, analogous or similar elements, and in which.

DETAILED DESCRIPTION OF THE PREFERRED EMBODIMENTS

Figure 1:
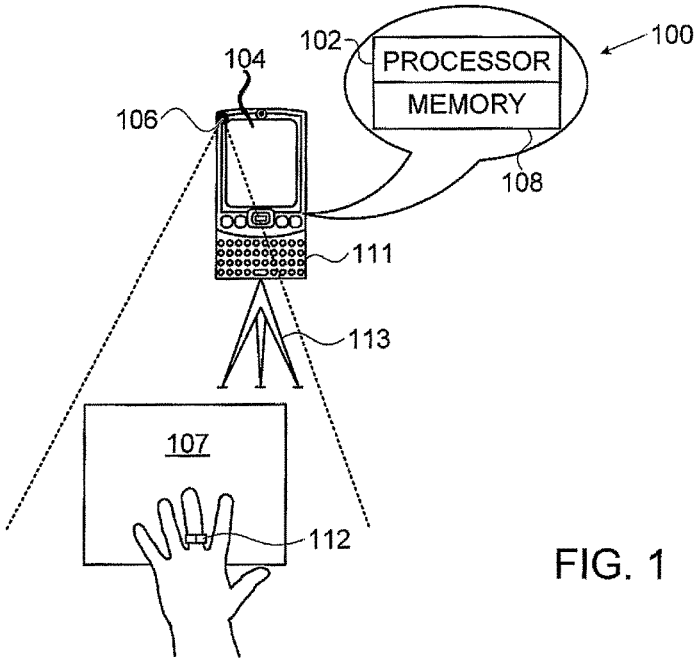
FIG. 1 is a conceptual illustration of a system in accordance with an embodiment of the invention.

In the following detailed description, numerous specific details are set forth in order to provide a thorough understanding of embodiments of the invention. However it will be understood by those of ordinary skill in the art that the embodiments of the invention may be practiced without these specific details. In other instances, well-known methods, procedures, and components have not been described in detail so as not to obscure the embodiments of the invention.

Unless specifically stated otherwise, as apparent from the following discussions, it is appreciated that throughout the specification, discussions utilizing terms such as "selecting," "evaluating," "processing," "computing," "calculating," "associating," "determining," "comparing", "combining" "designating," "allocating" or the like, refer to the actions and/or processes of a computer, computer processor or computing system, or similar electronic computing device, that manipulate and/or transform data represented as physical, such as electronic, quantities within the computing system's registers and/or memories into other data similarly represented as physical quantities within the computing system's memories, registers or other such information storage, transmission or display devices.

The processes and functions presented herein are not inherently related to any particular computer, network or other apparatus. Embodiments of the invention described herein are not described with reference to any particular programming language, machine code, etc. It will be appreciated that a variety of programming languages, network systems, protocols or hardware configurations may be used to implement the teachings of the embodiments of the invention as described herein. In some embodiments, one or more methods of embodiments of the invention may be stored on an article such as a memory device, where such instructions upon execution result in a method of an embodiment of the invention. In some embodiments, one or more components of a system may be associated with other components by way of a wired or wireless network. For example a memory and a processor may be in separate locations and connected by such a network.

As used in this application, and in addition to its regular meaning, the term game or interactive game may refer to a series of instructions, some of which may be executed by one or more players, by a processor or by a combination of players and a processor, whereupon such execution an action or response may be taken by another player, by the processor or by a combination of players and a processor. A game may also refer to a challenge or a series of challenges and responses taken by one or more participants, such as for example in the context of a card game, a word tile game, a letter game or other games. Some games may be played on a board having markings, instructions, or indications for a placement of a card, tile or other game pieces. A game may include the physical items used to play the game; for example a game may include the board and tiles. For example a Scrabble™ brand word tile game board may include a grid (typically on a board) surrounded by a frame, where such grid includes markings noting the spot where tiles or pieces may be placed, and where certain pre-defined spaces on the grid are marked with rules or values relating to the game and to tiles or words that are put on such spaces. Tiles may also have or be associated with pre-defined values. Such rules and values may be stored in a memory.

As used in this application, and in addition to their regular meanings, the terms word tile and letter tile may refer to playing pieces such as those made of wood, plastic, paper, cardboard or other materials, onto which are printed, etched or otherwise marked words or letters. Such tiles may be used in for example, mahjong, dominoes, the Scrabble™ brand word tile game, the Boggle™ brand word tile game, and various math, word, color or spelling games. Tiles may also include cards such as playing cards as may be used in games such as bridge, rummy, blackjack and others.

Reference is made to FIG. 1, a conceptual illustration of a system in accordance with an embodiment of the invention. In some embodiments, a system 100 may include a processor 102 as may be present in for example a personal computer, tablet computer, cell phone (cellular telephone), smart phone (smart telephone), game console or other electronic device, an electronic display 104 such as a television, cell phone screen, computer monitor or other display, a camera 106 (which may be an image capture mechanism or other imager such as for example a digital still or video camera, webcam or other imager). Processor 102 may be connected to, linked with or otherwise associated with, a memory 108 that may store for example one or more rules, values of time, or series of rules for an interactive game, a dictionary or other compendium of combinations of words, letters or cards, information about users or players in a game, and other information. Memory 108 may also store software or instructions which, when executed, result in the carrying out of methods according to the present invention. In some embodiments, one or more of processor 102, display 104, camera 106 and memory 108 may be housed in a single unit or housing 111 such as for example in the housing 111 of a smart phone. In some embodiments, housing 111 may be placed into stand 113 to direct a view of camera 106 towards an area of play of a game, such as towards a board upon which a game is to be played. In some embodiments, one or more players may wear or carry an object 112, such as a glove, ring, bracelet or other distinctive object that may be captured by camera 106 in an image and that may be associated in memory 108 with the player or user.

In some embodiments, display 104 may display one or more scenes 107 of a game, such as a game board or table upon which game tiles are placed, and may display one or more pieces, such as word or letter tiles or other representations of game pieces that may have been placed on such game board or in an area of play. For example, display 104 may show a backgammon board, where the red pieces represent a first player and black pieces represent a second player. Display 104 may show a Scrabble™ brand word tile game board with the representations of the letter tiles on the grid of the displayed board. In some embodiments, the board may not appear on the display 104. In some embodiments, assemblies or configurations of letter tiles making words or phrases that have been placed on the board may be displayed.

Figure 2:
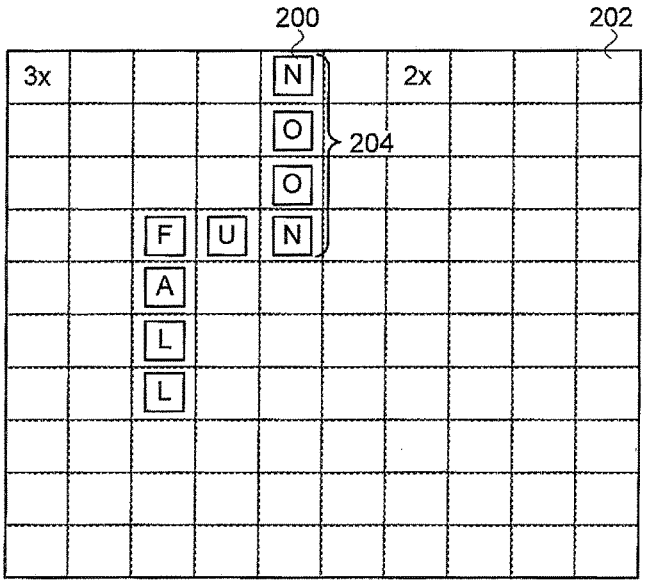
FIG. 2 is a schematic diagram of a Scrabble™ brand word tile game board onto which are placed letter tiles by a user, and a representation of the play on the board shown on a display, in accordance with an embodiment of the invention.

Reference is made to FIG. 2, a schematic diagram of a Scrabble™ brand word tile game board onto which are placed letter tiles by a user, and a representation of the play on the board shown on a display, in accordance with an embodiment of the invention. In operation, a player may perform an action such as for example placing letter tiles 200 onto a board 202 in a particular configuration to form a word 204 from such tiles 200. Camera 106 may capture an image or series of images of board 202 that may include an image captured before a new tile 200 or a series or configurations or tiles 200 was added to board 202. Another image of the board 202 may be captured after the new tiles 200 or word 204 was added to board 202. Processor 102 may compare the two images and detect the differences in tiles between the two images or the, changes or additional tiles 200 that appear or were placed on the board 202 during the period between the image from before and the image from after the tiles were added. In some embodiments, letters, symbols or other marks on the tiles may be detected in an image and recognized by associating the image with one of a series of stored images of letters or marks. A method and system of such detection and recognition is set out in PCT Application PCT/IL2012/000023 filed on Jan. 16, 2012 and entitled System and Method of Identification of Printed Matter in an Image Processor (the corresponding U.S. Patent Application Publication No. US 2013/0294700 is incorporated herein by reference). Processor 102 may isolate or identify the newly added tiles 200 or the difference between the tiles on the game space in the first image and the tiles on the game space in the second image, as well as the letters printed on tiles 200, and may associate such letters with values assigned to them in the game, as such values and rules may be stored in memory 108. For example, a value of a tile 200 with the letter E printed on it may be stored in memory 108 as 1, while a value of a tile 200 with the letter X may be stored in memory 108 as 8. Values may correspond to points according to the rules of the particular game. Processor 102 may calculate a value of such newly added tiles 200 and the words 204 that they form in accordance with rules of the game that were stored in memory 108. In some embodiments, a representation of the added letters, tiles 200 and words 204 may be presented on display 104. In some embodiments, a value of the added words 204 or letters (e.g., the score for a player's turn) may also appear on display 104, along with an indication such as by shading or coloring, as to which player added the tiles 200 or words 204.

Processor 102 may also detect the position or location of one or more of the tiles 200 on the board 202, and may apply the rules of the game to the tiles 200 that are associated with particular grid spaces or locations on the board where such pieces are determined to be located. For example, processor 102 may detect that a letter tile 200 is on a double letter space of the grid of board 202, and may store such information in memory 108.

The action or a move of a player may be captured by camera 106 in one or a series of images, and such action may be identified as being part of or associated with the player taking such action. For example, a player may register himself with processor 102 as taking his turn, by for example holding or shaking his arm or hand in view of camera 106 or taking some other pre-designated action with his hand in view of the camera 106. For example, when a player takes a turn or completes a move adding tiles 200 to the board 202, he may hold his hand up that may have object 112 on it, or may take some other action to register his turn at adding tiles 200 to board 202 or signal the completion of a move. An ending of a move or turn by a player may also be registered with processor 102 by a particular movement of the hand having object 112, such as a shake or making a fist, by the player whose turn finished. An image of the hand or arm as well as a color, structure or other characteristic of for example, object 112, skin, clothing, rings, bracelets or other items on the player's hand may be used to associate the hand with the player during the playing turn. Other actions may be used to signal the completion of or beginning of a move or turn.

Tiles 200 or words 202 added to the board 202 by the player during his turn may be attributed or associated by processor 102 with such player (e.g., a representation of the game status may be stored in memory 108), and the value or score of the words 204 or tiles 200 so added may be added to the existing score of the player as may have been stored in memory 108.

In some embodiments, a dictionary or other compilation of words, phrases or permitted configurations of tiles may be stored in memory 108, and processor 102 may compare words 204 that appear on board 202, to the stored dictionary to determine if the word 204 is permitted under the rules of the game. Processor 102 may issue a signal to indicate that the comparison successfully identified the added word 204, or alternatively that the word 204 is not acceptable if no successful comparison is found. For example, if the processor detects that a word, represented as a series of game tiles, has been added to a game space, it may compare the word to the list of words in a stored dictionary. If the comparison finds the added word to be the same as a permitted word in a dictionary, it may issue a signal to the players that the word is permitted and may signal a value of the added word in accordance with a rule of the game. If the comparison of the added word does not find a match to a permitted word in the dictionary, the processor may indicate that the word is not permitted or at least not recognized.

In some embodiments, a first player may play on a board 202 or a screen in a first location, and a second player may play against the first player on a different board 202 or screen in a second geographic or physical location (e.g., not two locations on the same board). In such case, two or more cameras 106 and displays 104 may be used to concurrently indicate the status of play and of the board 204 in one or both of such locations.

In some embodiments, an imager may capture an image of letter tiles 200 that are not on board 204, but that are associated with a user, such as the tiles that have been picked by a user and that are available for play by the user, e.g., on a rack, in a player's area or in a player's hand. Processor 102 may compare words in a dictionary stored in memory 108, to a combination of one or more of such letter tiles 200 with one or more words 204 or letters on tiles that are on board 202. Processor 102 may issue a signal to a user with a hint of possible uses on board 202 of one or more of his tiles 200.

Figure 3:
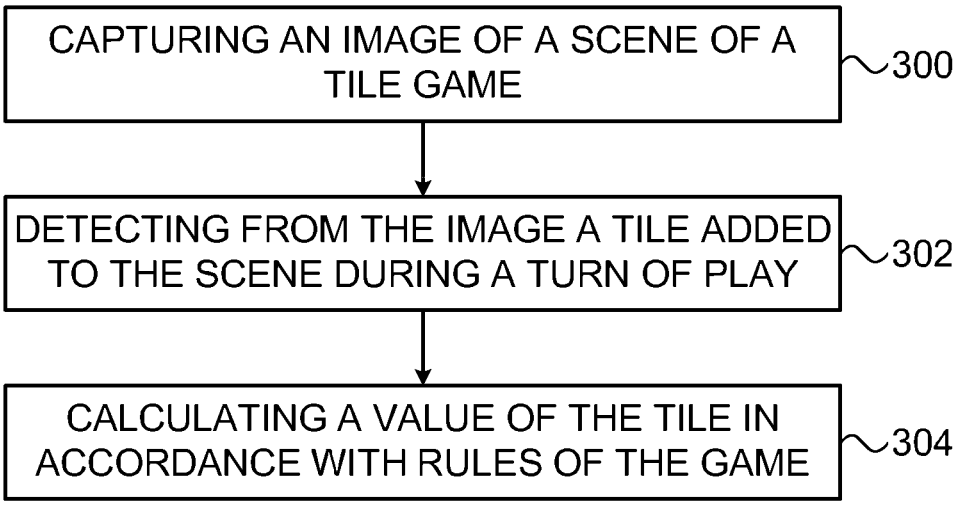
FIG. 3 is a flow diagram of a method in accordance with an embodiment of the invention.

Reference is made to FIG. 3, a flow diagram of a method of automated scoring of a tile game, in accordance with an embodiment of the invention. In block 300, a method may include capturing an image of a scene of a tile game where the scene includes for example the tiles that have been placed in play as part of the game. While in one embodiment, tiles are referred to, other games, not using tiles, may be used with a method according to the present invention. In general, such tiles that are in play exclude tiles that are for example still held in reserve by a player or in a 'kitty' or other reserve for later use. The scene may include for example a table, floor or other surface or area where tiles that are in play have been placed. For example, in a game such as the Bananagrams™ word game, a scene of a game may include one or more of the configurations of letter tiles that each player has already connected into words. An image may be captured by a camera, video camera, or other imager that may be held or suspended so that the playing area is in view of the images that it captures. For example, periodically, a person may use or manipulate a smart phone to image the game, or a smart phone may be positioned to continually view the game. In block 302, there may be detected in the captured image, one or more tiles that were added to the scene of play of the game during a turn of play. For example, an image of the scene or area of the game may show that one or more letter tiles were added to the scene or area of play during a player's turn of play. In block 304, a value or score may be calculated of the letter tiles that were detected as having been added to the playing scene during the turn of the player. The value may be calculated in accordance with rules of the game that may be stored in for example a memory. For example in the Scrabble™ brand word tile game, each letter tile may be associated with a number of points, and a calculation of the points of the added tiles may be made. In dominoes, each tile may be associated with a number of points and the points of the dominoes added to the domino table during a player's turn may be calculated.

In some embodiments, more than one tile may be added to an area or scene of play during a player's turn, and the values of each of the added tiles may be calculated and added to the existing score of a player who had executed the turn and put the tiles into play in the scene, as such existing score may have been stored in for example a memory. Such score may be displayed for example on a screen that is visible to one or more players.

In some embodiments, detecting the tiles in the image that were added during the turn of play may include capturing or taking a series of images of the scene of play, where a first image is taken before the turn is played and the pieces are put down, and a second image is captured after the turn. A comparison of the configuration of tiles in the two images may be made, and the difference may be assumed to include the pieces put down in the turn. A value of the tiles added between two images, such as a value of the difference between the tiles or words in the first image and the tiles or words in the second image, may be assume to be the value of the score of the player whose turn was taken between the two images. A signal may be issued by the processor by way of for example a display screen, of the calculated score or pre-defined value of the tiles or pieces put onto the game space in the player's turn.

In some embodiments a scene of a game as captured in an image may include or even be limited to a game board upon which the pieces are put into play. A processor may recognize for example a frame of such a game board in a first image and may use the area within the frame to find and detect relevant pieces that are placed into play. In some embodiments, a location of one or more tiles on the game board may be derived. For example, a memory may store an image or other data of placement of special locations on a Scrabble™ brand word tile game board, and such locations may indicate rules such as double letter score or triple word score that are associated with the locations on the board. The processor may determine a location of a tile placed on the board in the image, and may determine that a tile is in a location on one of such spaces. For example, a processor may determine that a red space of a triple word score is obscured by a tile, and may determine that a tile of a word configuration is located on the triple word score space. The processor may then calculate the value of the word that includes such obscuring tile in accordance with the triple word rule that is stored in memory. Other rules and values may be calculated in accordance with rules stored in a memory, and the letters or tiles configured on a board or playing scene. The calculated values may be added to a score that may be saved in a memory and associated with the player during whose turn the added tiles were detected.

In some embodiments a player may indicate that the imager is to capture an image of tiles that are in his 'kitty' or hand or in reserve and not yet entered into play. A processor may compare words stored in a dictionary in a memory with combinations of one or more tiles in such hand with one or more of the words or configurations of tiles that are in a playing area. A processor may signal the user of a result of such comparison so that a player receives a hint of possible uses of tiles in his hand as opportunities for use of his tiles that can be placed into play on a play area or board.

Embodiments of the invention may include an article such as a computer or processor readable non-transitory storage medium, such as for example a memory, a disk drive, or a USB flash memory device encoding, including or storing instructions, e.g., computer-executable instructions, which when executed by a processor or controller, cause the processor or controller to carry out methods disclosed herein.

It will be appreciated by persons skilled in the art that embodiments of the invention are not limited by what has been particularly shown and described hereinabove. Rather the scope of at least one embodiment of the invention is defined by the claims below.

I claim:

1. A method comprising:

capturing a first image of a first configuration of first letter tiles of a plurality of letter tiles;

capturing a second image of a second configuration of second letter tiles of said plurality of letter tiles;

detecting that said first configuration of first letter tiles differs from said second configuration of second letter tiles; and then, based on said detecting, comparing said second configuration of letter tiles in said second image to a plurality of words stored in a memory; and then, based on said comparing, issuing a signal identifying said second configuration of letter tiles with a word of said plurality of words stored in said memory.

2. The method as in claim 1, wherein said first image is captured before a turn of a game is played, and said second image is captured after a turn of a game is played.

3. The method as in claim 1, comprising placing a housing into a stand, said housing including an imager, wherein upon said placement of said housing in said stand, said imager is directed toward an area of play of a game, said game including said letter tiles.

4. The method as in claim 1, comprising displaying on an electronic display said word of said plurality of words stored in said memory.

5. The method as in claim 1, comprising detecting from said second image a completion of a turn of game play.

6. A system comprising:

an imager;

a processor associated with said imager; and a memory associated with said processor, said memory storing a plurality of words;

wherein said imager is to:

capture a first image of a first configuration of first letter tiles of a plurality of letter tiles, and capture a second image of a second configuration of second letter tiles of said plurality of letter tiles, and wherein said processor is to:

(i) detect that said first configuration of first letter tiles in said first image differs from said second configuration of second letter tiles in said second image, and then, (ii) compare said second configuration of second letter tiles captured by said imager to at least one word of said plurality of words stored in said memory, and then (iii) issue a signal if said configuration of second letter tiles captured by said imager is identified with a word of said plurality of words stored in said memory.

7. The system as in claim 6, wherein said processor is configured to issue a suggested configuration of letter tiles of said plurality of letter tiles.

8. The system as in claim 6, wherein said imager, said memory and said processor are included in a housing, and comprising a stand to hold said housing so said imager is in a view of said first configuration of first letter tiles and said second configuration of second letter tiles.

9. The system of claim 6 wherein said letter tiles are made of a material selected from: wood, plastic, paper, and cardboard.

10. The system of claim 6, wherein said first image of said first letter tiles is captured by said imager directed toward a first area of play of a game, and wherein said second image of said second letter tiles is captured by said imager directed toward a second area of play of a game, said game including said plurality of letter tiles.

11. The system of claim 10 wherein said first configuration of letter tiles and said second configuration of letter tiles are on a game board.

12. The system of claim 6, wherein said processor is further configured to:

(iv) provide a suggested configuration of letter tiles of said plurality of letter tiles.

13. The system of claim 12 wherein said suggested configuration is based on one or more words of said plurality of words stored in said memory.

14. The system of claim 13 wherein said housing is selected from:

a personal computer, a tablet computer, a cellular telephone, a smart phone; and a game console.

15. The system as in claim 6, wherein said imager, said memory, and said processor are included in a housing.

16. An article of manufacture comprising a non-transitory computer readable medium having stored thereon computer-readable instructions to be executed by a processor associated with an image capturing device, the computer-readable instructions including instructions for implementing a computer-implemented method operable on a device comprising hardware including memory and at least one processor, comprising:

capturing, with said image capturing device, a first image of a first configuration of first letter tiles of a plurality of letter tiles;

capturing, with said image capturing device, a second image of a second configuration of second letter tiles of said plurality of letter tiles;

detecting that said first configuration of first letter tiles differs from said second configuration of second letter tiles; and then, based on said detecting, comparing said second configuration of second letter tiles in said second image to a plurality of words stored in said memory; and then, based on said comparing, issuing a signal identifying said second configuration of second letter tiles with a word of said plurality of words stored in said memory.

17. The article of manufacture as in claim 16, wherein said instructions include issuing a suggested configuration of said plurality of letter tiles.

18. The article of manufacture of claim 16 wherein said image device is housed in one of:

a personal computer, a tablet computer, a cellular telephone, a smart phone; and a game console.

* * * * *